US005186983A

United States Patent [19]

Brown

[11] Patent Number: 5,186,983

[45] Date of Patent: Feb. 16, 1993

[54] PROCESS FOR DECORATING A HARD SURFACE

[76] Inventor: Robert J. Brown, 120 Hill Top Dr., Travelers's Rest, S.C. 29690

[21] Appl. No.: 660,527

[22] Filed: Feb. 25, 1991

[51] Int. Cl.[5] ..... B05D 5/00; B05D 1/32

[52] U.S. Cl. ..... 427/261; 427/282

[58] Field of Search ..... 427/261, 264, 272, 282

[56] References Cited

U.S. PATENT DOCUMENTS 2,065,322 12/1936 Robertson ..... 427/282 X 3,364,088 1/1968 Seman et al. ..... 427/272 X 3,712,825 1/1973 Yocuum ..... 427/261 X 4,329,820 12/1980 Salvador ..... 427/272

*Primary Examiner*—Evan Lawrence

*Attorney, Agent, or Firm*—Bailey & Hardaway

[57] ABSTRACT

A process for applying a decorative design to a hard surface is provided which utilizes a template with holes of a predetermined design cut by a water jet to give a feathered boundary to the holes. The feathered boundary enables a hard surface when painted to have the realistic appearance of a brick and mortar interface.

1 Claim, 1 Drawing Sheet

PROCESS FOR DECORATING A HARD SURFACE

BACKGROUND OF THE INVENTION

This invention relates generally to applying designs to hard surfaces and more particularly, to the art of applying a decorative design to a driveway surface.

Various techniques exist within the prior art for applying a design to a surface. Several of such techniques involve the use of a stencil.

U.S. Pat. No. 4,131,406 discloses a tool for making impressions in hardenable materials. However, it teaches using a platform tool with a plurality of penetrating blades to imprint a pattern upon a hardenable surface. U.S. Pat. No. 3,731,654 discloses a stencil device for manufacturing finished wall panels, wherein cut-out stencils are used, but it is not specified that the stencils to be used are produced in any special manner.

While such prior art techniques work well for their intended purpose, much room exists for improvement in the art.

SUMMARY OF THE INVENTION

It is therefore an object of the present invention to provide an improved process for applying a decorative design to a hard surface.

It is another object of this invention to provide such a process utilizing templates of various predetermined designs to apply a design to a hard surface.

It is a further object of this invention to provide a process for applying a design to a hard surface which results in a realistic appearance of a brick and mortar interface in one embodiment.

These as well as other objects are accomplished by a process utilizing a template with a plurality of holes of a predetermined design and constructed of a durable, stiff plastic material. The holes within the template have a feathered boundary, being cut out by a water jet. A mortar-colored paint is provided and initially applied to the hard surface. The template is then placed over the hard surface and a colored paint is applied thereby leaving a painted design with the appearance of a brick and mortar interface.

Other objects and a fuller understanding of the invention will become apparent from the following description given with the reference to the accompanying figures of drawing.

BRIEF DESCRIPTION OF THE DRAWINGS

FIG. 1A is an enlarged view of a design portion of FIG. 1.

DETAILED DESCRIPTION

In accordance with this invention, it has been found that a process for decorating a hard surface can be provided to apply various predetermined designs to a hard surface. It has also been found with the present invention that various predetermined designs can be applied to a hard surface in a manner so as to result in a realistic appearance of a brick and mortar interface.

The present invention produces various predetermined designs to a hard surface, ideally suited for application to driveways and sidewalks. A realistic appearance of a brick and mortar interface can be produced on a driveway or sidewalk simply by using a template according to this invention. Such a template can be of various designs and includes holes having a feathered boundary to enable a painted hard surface to have a realistic appearance of a brick and mortar interface. This feathered boundary of a template according to this invention unexpectedly results from the template being cut out by a water jet. Further advantages and features will become apparent from a reading of the following description given with reference to the various figures of drawing.

Figure 1:
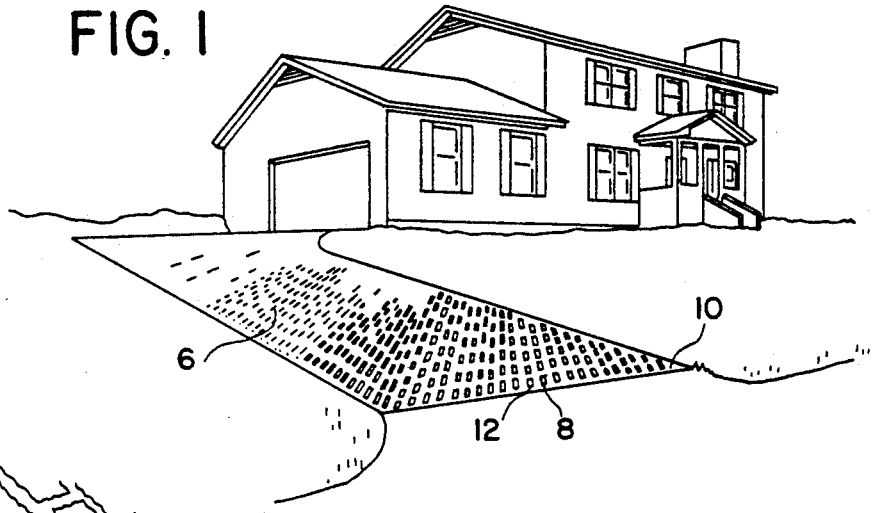
FIG. 1 illustrates a concrete driveway with a design thereon according to this invention.

FIG. 1 shows a resulting hard surface 6 with a painted design according to this invention. As illustrated, the hard surface 6 is exemplified as a driveway and has a design painted on it according to the template placed over it. The colored-paint sections 8 and the mortar-colored sections 10 are interfaced by a feathered boundary 12, which provides for a realistic appearance.

Figure 2:
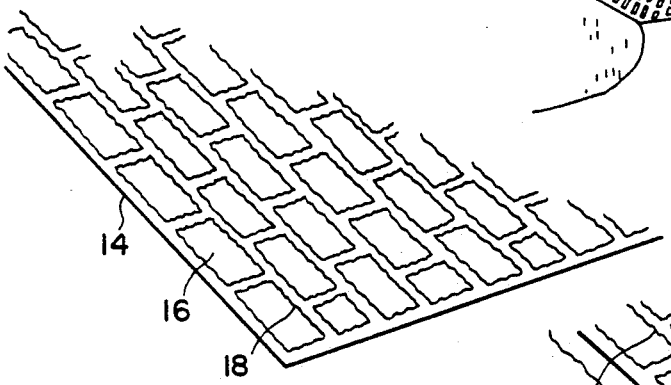
FIG. 2 is a fragmentary plan view of a template with a sample design according to this invention.

As seen in FIG. 2, a template 14 is provided which has a predetermined design. Template 14 is constructed of a durable, stiff plastic material, such as polyethylene, polyurethane, or a polyamide such as nylon, so that it may be repeatedly used to apply its design to a hard surface. Template 14 defines a design consisting of a plurality of holes 16 of a predetermined design. In accordance with this invention, the holes 16 within the template 14 are cut out by a water jet, thus giving the holes 16 a feathered boundary 18. This feathered boundary 18 is an important feature of this invention as it provides a template which can be used to result in a painted hard surface with a realistic appearance of a brick and mortar interface.

Figure 3:
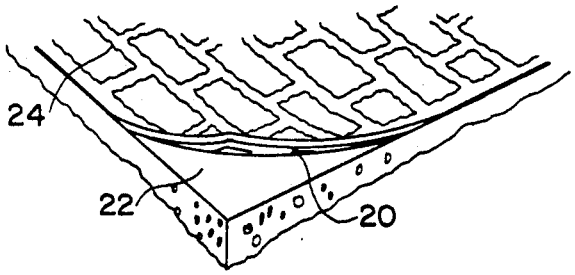
FIG. 3 is a fragmentary view in perspective showing a template with a sample design placed upon a hard surface.
Figure 4:
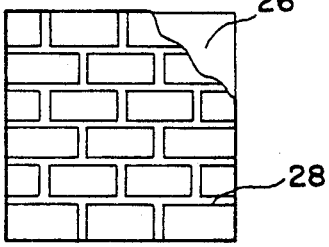
FIG. 4 illustrates a resulting painted hard surface of one design according to this invention.
Figure 5:
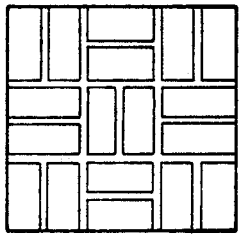
FIG. 5 illustrates a resulting painted hard surface of another design according to this invention.
Figure 6:
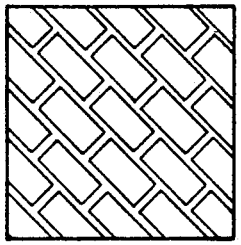
FIG. 6 illustrates a resulting painted hard surface of still another design according to this invention.
Figure 7:
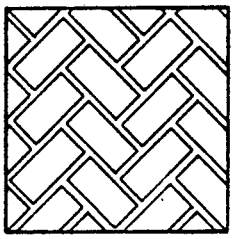
FIG. 7 illustrates a resulting painted hard surface of yet another design according to this invention.

FIG. 3 shows a template 20 placed upon a hard surface 22 according t the present invention. For illustration purposes only, the template 20 is shown partially stripped away from the hard surface 22. One step in applying a painted design to a hard surface 22 is placing the template 20 on a hard surface 22, as FIG. 3 illustrates.

To apply a painted design to a hard surface 22, the hard surface 22 is first painted with a mortar-colored paint. The template 20 with feathered edges 24 is then placed upon the hard surface 22 and a colored paint is used to paint the template 20 and the hard surface 22. As a distinctive feature of this invention, a brick-colored paint can be used to paint over template 20 and thus onto hard surface 22 so that the resulting painted hard surface has a feathered boundary 24 providing a realistic appearance of a brick and mortar interface. This feature is especially ideal for concrete driveways and sidewalks to provide a realistic brick and mortar appearance. An advantage of using a stiff, durable material to construct the template 20 is that after some wear has occurred to the hard surface, the same template of stiff, durable material may be placed over the same hard surface, such as a driveway, and recoated in the brick appearing area. If the template 20 were constructed of a weaker material, such feature would not exist because of the distortion which would occur with the use of the template.

FIGS. 4, 5, 6 and 7 all show a resulting painted hard surface according to this invention, each hard surface having a different predetermined design. The illustrations of particular designs are preferred embodiments, and such designs are not intended to be limited to those specified. As seen in FIGS. 4,5,6 and 7, templates (not shown) of various predetermined designs may be used to produce various predetermined designs upon a hard surface 26. Each hard surface 26 has a design painted on it with a realistic appearance of a brick and mortar interface 28. This brick and mortar interface 28 appearance results from using a template including holes with a feathered boundary in accordance with this invention.

Because of the scale of FIGS. 4 through 7, the feathered interface 28 is less perceptible than the exaggerated boundary 18 of FIG. 2.

It is thus seen that the invention provides an improved process for applying a decorative design to a hard surface. The present invention utilizes a template which is durable and can be repeatedly used to apply a design to a hard surface. It is further seen that templates of various predetermined designs are provided for use in applying a design to a hard surface, and that in one embodiment of this invention, a hard surface such as concrete results in a realistic appearance of a brick and mortar interface. Many variations will become apparent to those of skill in the art, and such variations are embodied within the spirit and scope of the present invention as measured by the following appended claims.

I claim:

1. A process of decorating a hard surface comprising:

providing a mortar-colored paint;

providing a template constructed of a durable, stiff plastic material, said template having holes cut therein, said holes having feathered edges;

providing a colored paint;

painting said hard surface with said mortar-colored paint;

placing said template over the painted mortar-colored surface;

painting over said template and thus onto the painted mortar-colored surface with said colored paint whereby the colored paint partially covers the mortar-colored surface, thereby leaving a painted design having feathered boundaries on said surface.

* * * * *